US005673622A

United States Patent [19]

Larsson

[11] Patent Number: 5,673,622

[45] Date of Patent: Oct. 7, 1997

[54] DEVICE FOR WETTING AND CLEANING CYLINDERS IN AN OFFSET ROTARY PRINTING MACHINE

[75] Inventor: Magnus Larsson, Asarum, Sweden

[73] Assignee: Grafiskt Team AB, Nassjo, Sweden

[21] Appl. No.: 628,672

[22] PCT Filed: Oct. 11, 1994

[86] PCT No.: PCT/SE94/00954

§ 371 Date: May 29, 1996

§ 102(e) Date: May 29, 1996

[87] PCT Pub. No.: WO95/10414

PCT Pub. Date: Apr. 20, 1995

[30] Foreign Application Priority Data

Oct. 11, 1993 [SE] Sweden ..... 9303368

[51] Int. Cl.[6] ..... B41F 7/24

[52] U.S. Cl. ..... 101/147; 101/425

[58] Field of Search ..... 101/147, 148, 101/366, 424, 425, 423; 239/93, 101, 583, 585.4

[56] References Cited

U.S. PATENT DOCUMENTS

| | | | |
|---|---|---|---|
| 3,764,070 | 10/1973 | Glaser | 101/147 |
| 4,873,925 | 10/1989 | Hultberg et al. | 101/147 |
| 5,025,722 | 6/1991 | Switall et al. | 101/147 |
| 5,303,652 | 4/1994 | Gasparrini et al. | 101/425 |
| 5,505,126 | 4/1996 | Ohno et al. | 101/147 |

FOREIGN PATENT DOCUMENTS 3815248 11/1989 Germany .

*Primary Examiner*—Ren Yan

*Attorney, Agent, or Firm*—Merchant, Gould, Smith, Edell, Welter & Schmidt P.A.

[57] ABSTRACT

Device for wetting and/or cleaning solenoids in an offset rotary printing machine having a plate cylinder, an offset cylinder and an impression cylinder. The device comprises wetting cylinders running against the plate cylinder and a ramp with several nozzles for spraying liquid towards the wetting solenoids in atomized condition, said ramp being mounted in parallel with the rotational axes of the cylinders. A valve is provided for each nozzle having at least one separate solenoid controlled inlet for liquid and an outlet to the associated nozzle. The solenoid control inlet comprises a valve with a solenoid armature (25) which is spring biased towards the closed position of the valve, and a valve element (26, 27) displaceably mounted in the solenoid armature and spring biased towards the closed position of the valve, said valve element in this position engaging a valve seat. Abutments (30, 31) for limiting the displacement of the valve element in relation to the solenoid armature under the spring bias of the valve element are provided on the solenoid armature and the valve element, said abutments being kept separated against the spring bias of the valve element when the valve element engages the valve seat. The invention also relates to a method in operating the device wherein the solenoid current at opening of the valve after an initial increase at constant voltage over the solenoid is adjusted to a predetermined value which is maintained for a predetermined period the current then being decreased below the predetermined value to be kept at a lower value while the valve is in open position.

5 Claims, 3 Drawing Sheets

DEVICE FOR WETTING AND CLEANING CYLINDERS IN AN OFFSET ROTARY PRINTING MACHINE

BACKGROUND OF THE INVENTION

The invention relates to a device for wetting and cleaning cylinders in an offset rotary printing machine of the type including a plate cylinder, an offset cylinder, and an impression cylinder as well as wetting cylinders running against the plate cylinder, said wetting cylinders being moistened from a number of nozzles in a ramp mounted in parallel to the rotational axis of the cylinders, by a moistening fluid, usually water, being sprayed from the nozzles towards one of the wetting cylinders in atomized condition. Each nozzle has an inlet for moistening fluid and an inlet for a cleaning liquid, and these inlets can be opened and closed individually by means of a solenoid valve in order to supply moistening fluid or cleaning liquid, respectively, through the nozzle. The solenoid valves are computer controlled in dependence of different operating parameters of the printing machine.

SUMMARY OF THE INVENTION

The purpose of the invention is to simplify the construction of the nozzle ramp by providing a compact and economical valve arrangement wherein the valves are able to open and close rapidly without bouncing causing residual spray, and wherein the period between zero flow and maximum flow is as short as possible. Then, pressure drops and pressure peaks which arise at the rapid opening and closing of the valves and which cannot be neglected shall be eliminated by pressure equalization in the conduit system to the inlets of the valves.

The purpose of the invention is also to provide adjustment of the valves at high speed and high timely precision without too much energy being dissipated in the valves.

BRIEF DESCRIPTION OF THE DRAWINGS

In order to explain the invention in more detail reference is made to the accompanying drawings in which.

DETAILED DESCRIPTION OF THE PREFERRED EMBODIMENT

Figure 1:
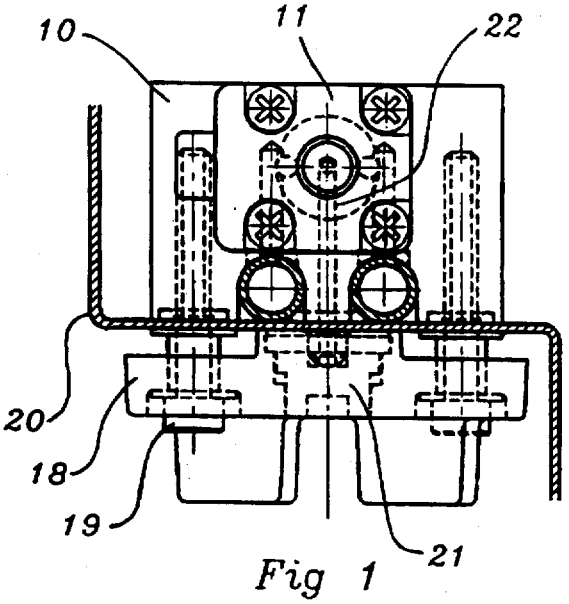
FIG. 1 is a side view of a valve unit according to the invention.
Figure 2:
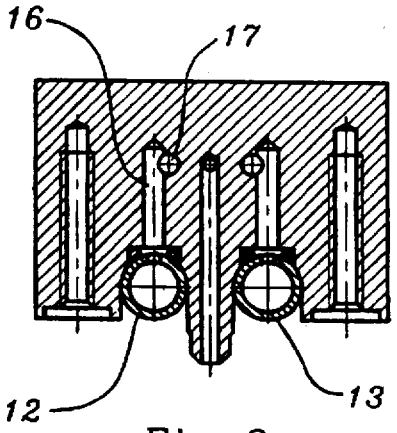
FIG. 2 is a fragmentary vertical cross sectional view of the valve unit in FIG. 1.
Figure 3:
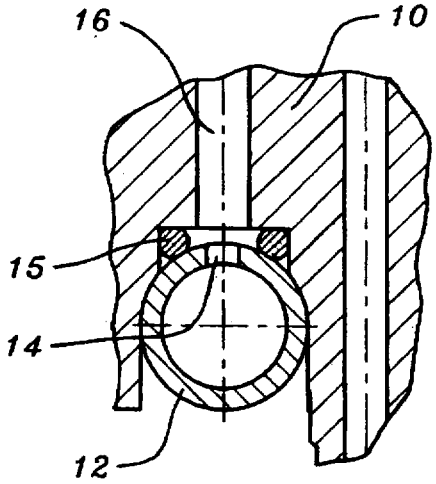
FIG. 3 is an enlarged cross sectional view forming part of FIG. 2.

The wetting ramp can comprise a number of nozzles e.g. twelve, arranged in a row each nozzle having two valves for controlling the supply of water (moistening fluid) and cleaning liquid to the nozzles. For each nozzle there is provided a valve housing 10, two solenoids 11 being connected to said housing. The valve housing straddles two conduits 12 and 13 one for supplying water and the other for supplying cleaning liquid, as shown in FIG. 2, and as will more clearly seen in FIG. 3 an aperture 14 is made in conduit 12. An O-ring 15 is provided around the aperture to seal between the valve housing and the conduit. Through the aperture, the conduit is connected with a passage 16 in valve housing 10, said passage in turn communicating with a passage 17 in valve housing 10. Conduit 13 is connected in a corresponding manner. A yoke 18 and the valve housing are mounted by means of a screw connection 19 on a support rail 20. A spray nozzle 21 is mounted in the yoke, communicating with a supply passage 22 which is connected to a passage 23 in valve housing 10 at the center of this latter passage.

Figure 5:
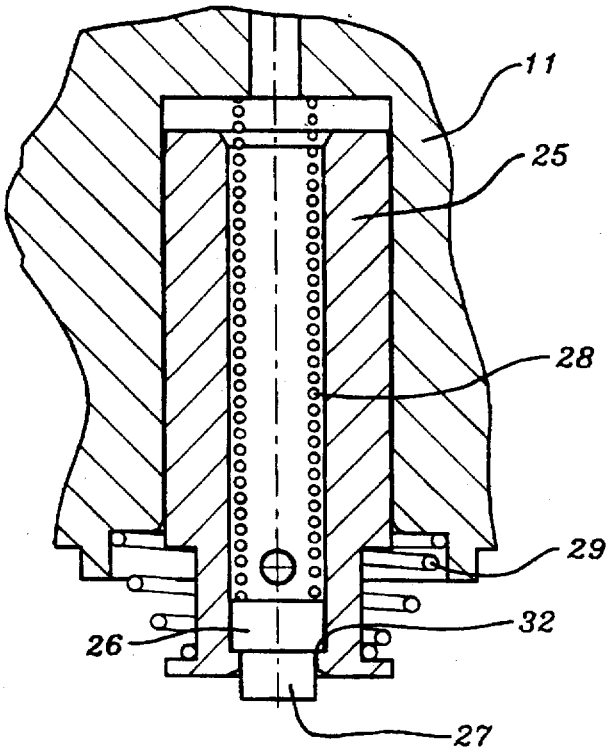
FIG. 5 is an enlarged axial cross sectional view of a solenoid armature having a valve element of rubber or rubber-like material.
Figure 6:
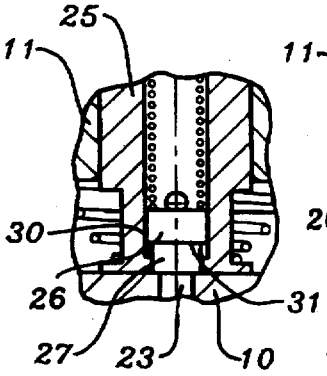
FIGS. 6 to 9 are fragmentary views in reduced scale of the solenoid armature disclosing different functional positions.

Each end of passage 23 opens into a recess 24, and passages 17 open each into one of the two recesses. The armature 25 of each solenoid 11 has a plunger 26 displaceably guided therein, as well as a rubber element 27, FIG. 5, provided as a valve element. A compression spring 28 biases plunger 26 and armature 25, and also a compression spring 29 which is weaker than spring 28 biases the armature. By the bias of spring 28 rubber element 27 is kept engaged with the bottom of recess 24 and keeps the end of passage 23 closed (FIG. 6). When the armature is attracted it moves initially against the bias of spring 29 in relation to piston 26, the rubber element 27 still being in closed position (FIG. 7) until a shoulder 30 on the armature engages a shoulder 31 on the plunger at 32. Then, the armature moves against the bias of springs 28 and 29 and lifts the plunger and the rubber element so that passage 23 will be uncovered, FIG. 8. After further movement the completely opened position according to FIG. 9 will be reached. In the diagram according to FIG. 10 the graph 33 represents the opening force and graph 34 represents movement of valve element 27. When the valve element is in open position one of passages 17 is connected to passage 23 for supply of water or cleaning liquid, respectively, to the nozzle.

Figure 7:
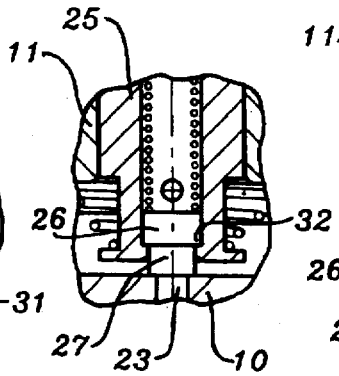
Figure 8:
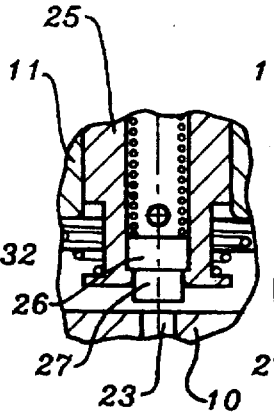
Figure 9:
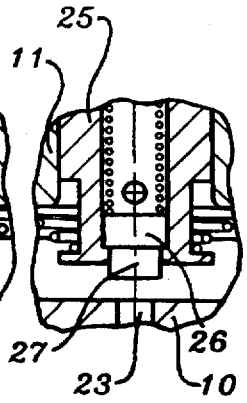
Figure 10:
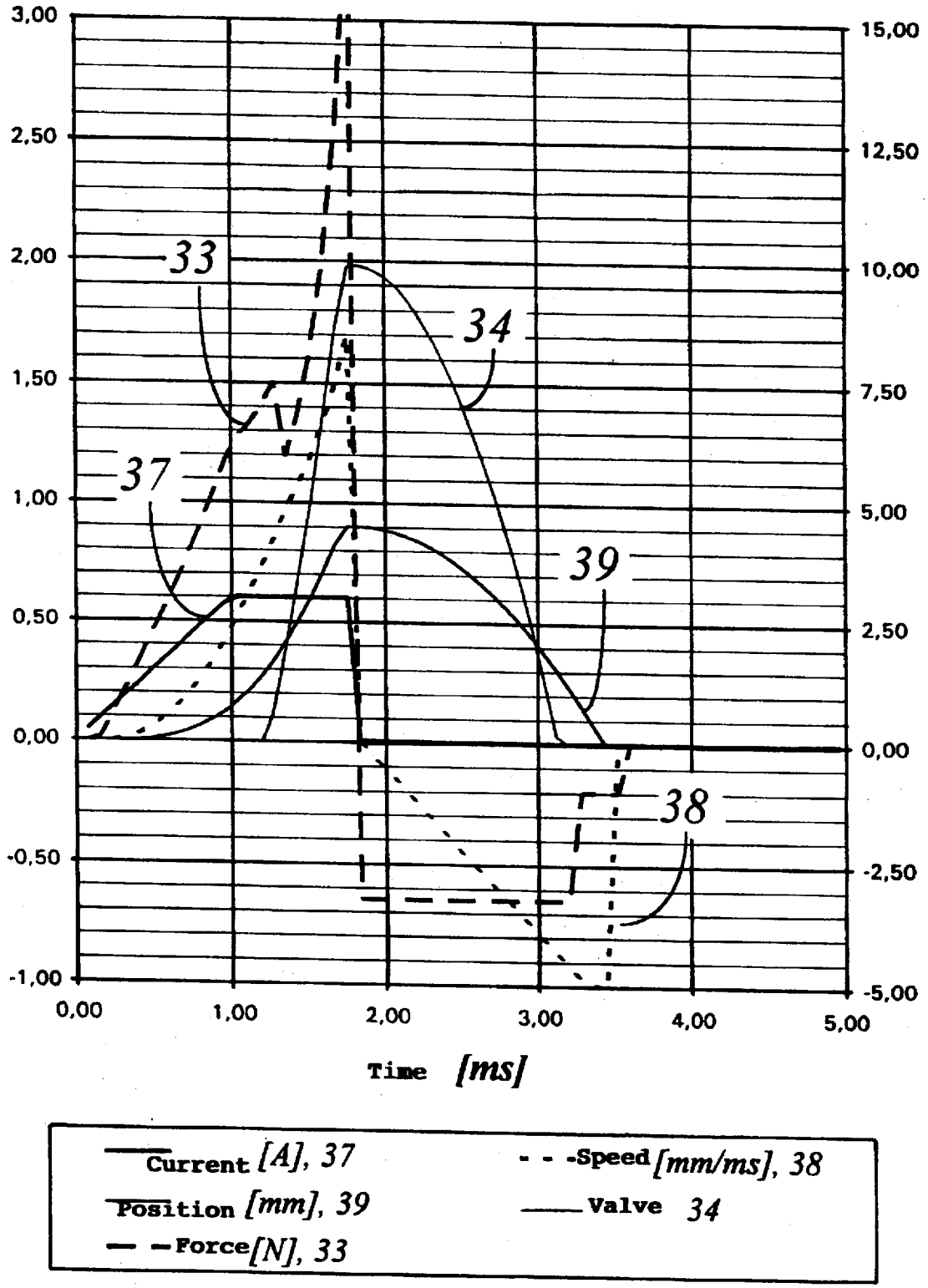
FIG. 10 is a diagram illustrating different parameters of the valve function.

According to the invention the valve is constructed so that the armature and the plunger with the rubber element can move in relation to each other and the armature and the plunger with the rubber element are allowed to move a distance at opening of the valve, which is longer than that required in order to obtain the necessary maximum flow. In this manner the operating cycle of the valve can be divided into three steps. At opening, the acceleration step is shown in FIG. 7 during which the armature 25 moves without the plunger 26. The opening step is shown in FIG. 8 during which the flow is changed. The over-movement step is shown in FIG. 9 which guarantees that bounces when the armature is arrested do not result in a change of the flow. At closing, the operation is similar to that of at opening with the exception that in the acceleration step (FIG. 7) the armature as well as the plunger with the rubber element move without the flow being decreased, and in the over-movement step (FIG. 9) the armature only, not the plunger with the rubber element, are moving. It should be noted that the rubber element need not take up inertia forces from the armature, which provides a longer life of the rubber element. By the function of the valve as described large liquid droplets are avoided at opening and closing.

Figure 4:
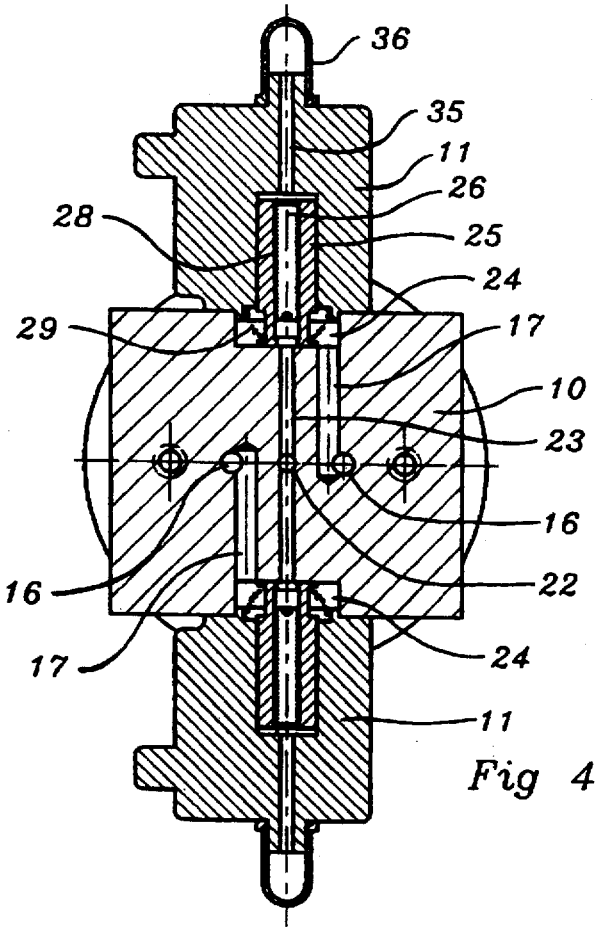
FIG. 4 is a horizontal cross sectional view of the valve unit in FIG. 1.

In order to eliminate such disturbances of the spray pattern and damages on the conduit system which may be caused by pressure drops and pressure peaks, an attenuator is provided (FIG. 4). Recess 24 is connected by a passage 35 with a space inside an elastic dome 36. This dome can expand and retract, respectively, at pressure peaks and pressure drops, respectively. The attenuator can also have two spaces separated by an elastic membrane; one space is connected to passage 35 and the other space contains a compressible element e.g. a gas or a spring. The attenuator can be connected at any place in the conduit system but preferably should be connected as close as possible to the valve.

In order to obtain a sufficiently low time separation during the opening periods of the valves a large amount of hardware (counters etc.) is required. In order to reduce the need of hardware and thus to reduce the cost for the system a method is provided according to the invention, wherein the physical time resolution is increased. By the introduction of a calculation function storing a residual value between two opening operations following one upon the other the mean value of a number of such opening operations can be set with a better resolution than that of the individual opening operation. Assuming for example that the opening period 17.33 is required for a certain amount of moisture and that the valve can be controlled in steps of integers of the opening period only. Then, the opening sequence 17, 17, 18 is introduced said sequence having a mean value of 17.33.

When the wetting cylinder in the printing machine is moistened by spraying it is of greatest importance that the valve controlling the moistening liquid can be opened and closed at high speed and at high timely 10 accuracy. In order to obtain rapid opening of a solenoid valve it is required that there is obtained a rapid increase of the current through the coil of the valve (the force which accelerates the armature is a function of the current). In order to obtain the same delay and increase of flow when a valve is being opened it is required that current and voltage are controlled according to a predetermined pattern. In the first step of the opening cycle the change of the current is dependent substantially on the voltage applied, and it is therefore important that this voltage is constant. When the current, graph 37 in FIG. 10, has increased to a predetermined value (typically to two or three times the nominal current) which provides the desired accelerating forces, the optimal step is to adjust the current to the predetermined level. In this manner resistance changes in the coil and conductors will not effect the force, graph 33 in FIG. 10, which actuates the armature. Thus, a more controlled opening process will be obtained, graph 34 in FIG. 10, for the valve. When the predetermined current has been reached and then is being maintained for a predetermined time the armature has accelerated to a speed according to graph 38 in FIG. 10 and moves towards the arrested position. At this time the air gap (in this case filled with liquid) in the magnetic circuit has also decreased so that the current required to obtain the necessary forces in order to maintain the armature in the inner position thereof, graph 39 in FIG. 10, has decreased considerably. In order not to pass the maximum power loss of the coil, that can be allowed, it is now suitable to reduce the current below the nominal value during the remaining time during which the valve has to be open. When the valve shall be closed the current through the coil must be reduced to zero as rapidly as possible in order that the magnetic force on the armature shall cease and the armature shall return to the rest position thereof by the spring/springs as rapidly as possible. A rapid reduction of the current is obtained by reversing the voltage over the coil.

In the embodiment described the passages 22 and 23 are connected via the two valves to one and the same nozzle 21 but it is also possible to let one valve control the flow through a nozzle for water and to let the other valve control a nozzle for cleaning liquid; each valve thus is associated with a separate nozzle.

I claim:

1. Device for wetting and/or cleaning cylinders in an offset rotary printing machine comprising:

a plate cylinder;

an offset cylinder;

an impression cylinder;

wetting cylinders running against the plate cylinder;

a ramp, having a plurality of nozzles, mounted in parallel to rotational axes of the cylinders for spraying liquid towards one of the wetting cylinders in an atomized condition;

a valve for each nozzle having at least one separate solenoid controlled fluid passage and a second fluid passage being engageable with a valve element of the valve, said at least one separate solenoid controlled fluid passage being disposed in a valve housing; and the valve comprising:

a solenoid armature which is spring biased towards a closed position of the valve;

the valve element displaceably mounted in the solenoid armature, said valve element being spring biased towards the closed position of the valve and engaging with the second fluid passage in the closed position;

a first shoulder member being disposed on the solenoid armature; and a second shoulder member being disposed on the valve element, the first and second shoulders being engageable with each other so as to limit displacement of the valve element in relation to the solenoid armature under influence of a spring bias of the valve element, the first and second shoulder members being kept separated against the spring bias of the valve element when the valve element engages the second fluid passage.

2. Device according to claim 1, wherein an expandable and contractable attenuating member for equalizing pressure peaks and pressure drops at an operation of the valve communicates with said at least one separate solenoid controlled fluid passage.

3. Device according to claim 1, wherein the valve housing straddles a supply conduit for liquid with said at least one separate solenoid controlled fluid passage in register with an aperture in the supply conduit and is clamped against the supply conduit, a sealing ring surrounding the aperture is provided between the valve housing and the supply conduit.

4. Method of controlling a device for wetting and/or cleaning cylinders in an offset rotary printing machine which comprises:

a plate cylinder;

an offset cylinder;

an impression cylinder;

wetting cylinders running against the plate cylinder;

a ramp, having a plurality of nozzles, mounted in parallel to rotational axes of the cylinders for spraying liquid towards one of the wetting cylinders in an atomized condition;

a valve for each nozzle having at least one separate solenoid controlled fluid passage and a second fluid passage being engageable with a valve element of the valve, said at least one separate solenoid controlled fluid passage being disposed in a valve housing; and the valve comprising:

a solenoid having a solenoid armature which is spring biased towards a closed position of the valve;

the valve element displaceably mounted in the solenoid armature, said valve element being spring biased towards the closed position of the valve and engaging with the second fluid passage in the closed position;

a first shoulder member being disposed on the solenoid armature; and a second shoulder member being disposed on the valve element, the first and second shoulders being engageable with each other so as to limit displacement of the valve element in relation to the solenoid armature under influence of a spring bias of the valve element, the first and second shoulder members being kept separated against the spring bias of the valve element when the valve element engages the second fluid passage;

the method comprising the steps of:

providing an initial solenoid current at opening of the valve after an initial increase at constant voltage over the solenoid;

adjusting the solenoid current to a predetermined value which is maintained for a predetermined period; and decreasing the solenoid current below the predetermined value so as to be maintained at a lower value while the valve is in an open position.

5. Method according to claim 4, further comprising a step of reversing the voltage over the solenoid for rapid decrease of the solenoid current to zero at closing of the valve.

* * * * *